United States Patent [19]

Jeannotte

[11] 4,070,932

[45] Jan. 31, 1978

[54] EXTENSIBLE HANDLE FOR A TOOL HEADPIECE

[76] Inventor: Richard W. Jeannotte, P.O. Box 132, Shelby, Mont. 59474

[21] Appl. No.: 773,219

[22] Filed: Mar. 1, 1977

[51] Int. Cl.[2] ..... B25G 1/04

[52] U.S. Cl. ..... 81/177 A; 16/115

[58] Field of Search ..... 81/177 A, 177 R, 177 N; 145/61 L; 16/115; 15/144 B; 401/112; 403/107, 109, 166; 248/423, 188.5

[56] References Cited

U.S. PATENT DOCUMENTS

| | | | |
|---|---|---|---|
| 400,944 | 4/1889 | Powell | 64/1 |
| 1,030,592 | 6/1912 | Leland | 403/107 |
| 1,203,853 | 11/1916 | Contal | 145/66 |
| 1,284,351 | 11/1918 | Jagielo | 403/107 |
| 1,424,794 | 8/1922 | Ayotte | 81/177 A |
| 1,575,593 | 3/1926 | Seiter | 81/177 R X |
| 2,282,148 | 5/1942 | Mandl | 74/544 |
| 2,438,633 | 3/1948 | Condor | 403/107 |
| 2,483,396 | 10/1949 | Benson | 403/109 X |
| 2,520,652 | 8/1950 | Pfauser | 74/544 |
| 2,592,978 | 4/1952 | Trimboli | 81/177 A X |
| 2,869,410 | 1/1959 | Prichard | 81/177 A |
| 2,963,930 | 12/1960 | Clothier | 81/177 |
| 2,964,981 | 12/1960 | Blunt | 81/177 |

FOREIGN PATENT DOCUMENTS

| | | | |
|---|---|---|---|
| 524,863 | 4/1955 | Italy | 81/177 A |

*Primary Examiner*—James L. Jones
*Assistant Examiner*—Nicholas P. Godici
*Attorney, Agent, or Firm*—Bacon & Thomas

[57] ABSTRACT

An extensible handle for applying increased torque to a tool headpiece, such as a ratchet wrench. The handle includes a sleeve which carries the tool headpiece. A rod is telescopically received within the sleeve and is resiliently biased towards an extended position. A latch is provided for locking the rod in at least a first retracted position of lesser torque and a second extended position in which greater torque may be applied to the tool headpiece.

5 Claims, 5 Drawing Figures

Fig. 1.
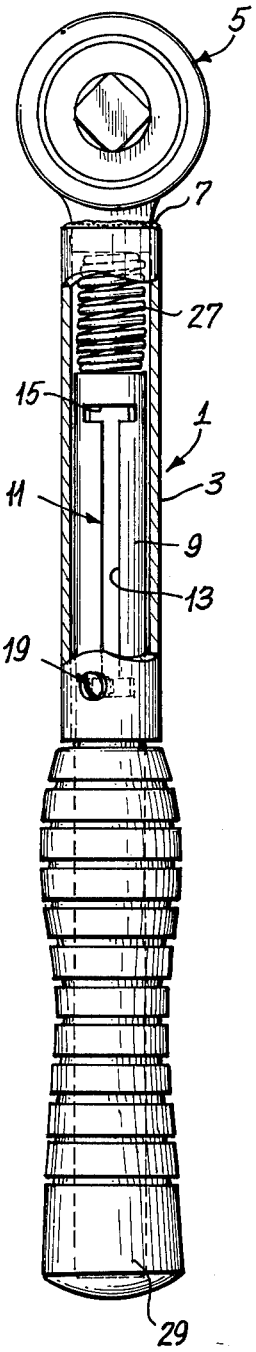
Fig. 2.
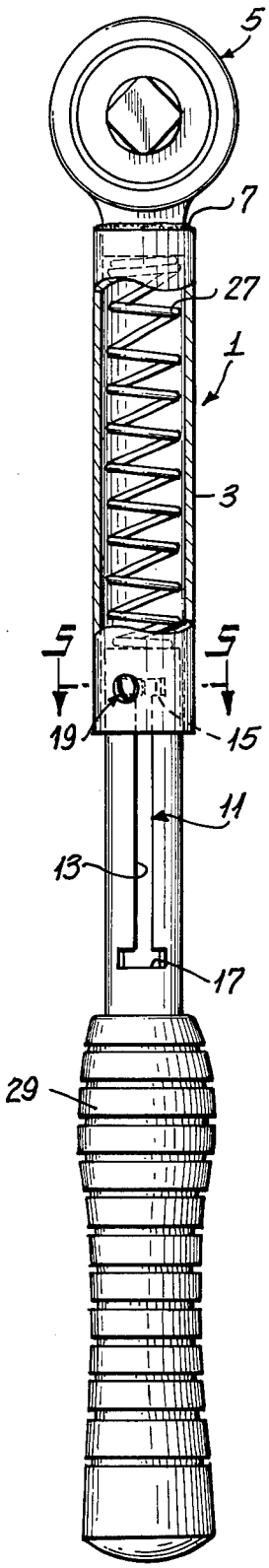
Fig. 5.
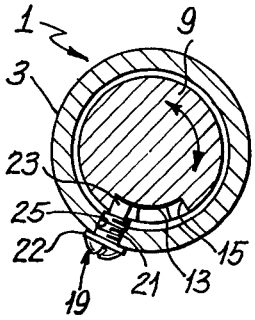
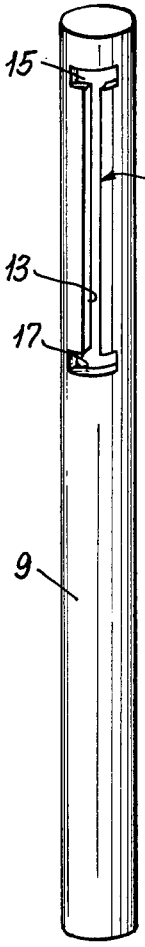
Fig. 3.
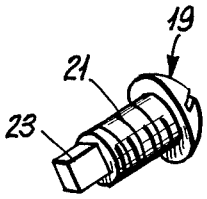
Fig. 4.

EXTENSIBLE HANDLE FOR A TOOL HEADPIECE

BACKGROUND OF THE INVENTION

1. Field of the Invention

This invention relates generally to extensible handles for use with tools. More particularly, the invention is directed to an extensible handle for applying different degrees of torque to a tool headpiece, such as a ratchet wrench, carried by the handle.

2. Description of the Prior Art

It is known to provide hand tools such as wrenches and the like with handles which may be temporarily extended for the purpose of increasing the effective leverage so that additional torque may be applied to the tool headpiece carried at the end of the handle. This is particularly advantageous when it is desired to provide extra pressure in tightening or loosening a threaded bolt or similar type of fastener.

Such tools with extensible handles usually include some provision for locking the extended portion of the handle in one or more desired positions of extension depending upon the amount of leverage and torque desired for a given application. This locking mechanism should desirably be easily manipulated and quickly engaged or disengaged so that the user of the tool will not be required to devote an inordinate amount of time or attention in adjusting for the desired degree of extension. Accordingly, such a tool handle should be capable of being quickly extended for a temporary period of special use and thereafter quickly retracted to its normal position for general use and storage.

Another desirable feature of an extensible tool handle is that the locking mechanism must be capable of securing the extensible portion of the handle in a very rigid and secure interconnecting relationship with the fixed portion of the handle so that the entire extended handle will properly function as a strong integral unit.

It is also further desirable to provide a locking mechanism which will function to maintain the extensible portion of the handle in its desired position notwithstanding the type of tool headpiece being utilized or the type of force being applied. For example, an extensible handle structure suitable for use in applying torque to a wrench headpiece should advantageously also be capable of supporting and applying torque to a tool headpiece such as a screwdriver or drill bit.

The prior art has indicated various approaches to providing an extensible handle for a handheld tool. For example, the use of a hollow sleeve having spaced internal threaded portions which may alternatively be screwed onto the fixed portion of the handle by reversing the position of the sleeve is known.

However, probably the most prevalent form of extensible handle construction involves the utilization of two elongated members that are telescopically retractable and extensible with respect to each other. The various positions of extension are maintained by some form of locking mechanism, such as a thrumbscrew or cooperating pin and groove assembly.

Specific examples of such prior art extensible handles are shown by the Jagielo U.S. Pat. No. 1,284,351; Mandle U.S. Pat. No. 2,282,148; and Blunt U.S. Pat. No. 2,964,981.

SUMMARY OF THE INVENTION

It is an object of the present invention to provide for an improved extensible tool handle which can be easily and quickly extended and retracted into at least two positions of use.

It is another object of the invention to provide an extensible tool handle having a simple and secure latching mechanism for locking the extensible portion of the handle in its positions of extension and retraction.

It is still another object of the invention to provide an extensible tool handle which can be utilized for applying different degrees of torque to a wrench or similar type of tool headpiece.

It is yet still another object of the invention to provide an extensible tool handle which may be utilized in conjunction with a variety of tool headpieces and applications of use.

It is yet a further object of the invention to provide an extensible tool handle having a provision for facilitating the placement of the handle in an extended position of use.

The present invention achieves the foregoing and other objects by providing an extensible tool handle that includes a sleeve which caries a tool headpiece at one end thereof. The sleeve forms the fixed portion of the handle and telescopically receives an extensible portion through its other end. The extensible portion may include a rod having an I-shaped groove formed along its longitudinal surface adjacent the end which is received within the sleeve. A resilient biasing means is disposed within the sleeve and serves to urge the rod outwardly towards a position of extension. A latching mechanism carried by the sleeve includes an abutment which is disposed within the groove. By selectively reciprocating and rotating the rod within the sleeve, the abutment portion of the latching mechanism will be caused to engage the longitudinal leg of the groove of either its opposite transverse leg portions so that the rod may be secured in at least two positions separated and defined by the distance between the transverse portions of the groove.

These and other objects of the present invention will be apparent from the following description and appended claims, reference being made to the accompanying drawings forming a part of the specification wherein like reference drawings designate corresponding parts in the several views.

BRIEF DESCRIPTION OF THE DRAWINGS

FIG. 1 is an elevational view, partly in section, of the extensible tool handle of the present invention with the handle being depicted in its retracted position.

FIG. 2 is an elevational view, partly in section, of the handle of FIG. 1 in its extended position;

FIG. 3 is a perspective view of the extensible portion of the handle;

FIG. 4 is an enlarged perspective view of the latching mechanism which locks the extensible portion of the handle in its respective positions of extension and retraction; and FIG. 5 is an enlarged horizontal sectional view, taken on the line 5—5 of FIG. 2.

DETAILED DESCRIPTION OF THE PREFERRED EMBODIMENTS

An extensible tool handle 1 of the present invention is depicted in its positions of retraction and extension in FIG. 1 and FIG. 2, respectively. Handle 1 includes a sleeve 3 having a tool headpiece 5 in one end thereof. Headpiece 5 is depicted as a ratchet wrench, but may be any of a variety of tools which may be found suitable for use in conjunction with handle 1. Headpiece 5 may be secured to sleeve 3 by any well known means of interconnection, such as threads or by welding, the latter being generally indicated at 7.

A rod 9, forming the extensible portion of handle 1 and having a greater overall length than sleeve 3, is telescopically received within sleeve 3. As seen in FIG. 3, an I-shaped groove 11 is provided along the longitudinal surface of rod 9 adjacent one end thereof. Groove 11 includes a longitudinal leg portion 13, a first transverse leg portion 15 and a second transverse leg portion 17.

A latch mechanism 19 is carried by sleeve 3 for the purpose of securing rod 9 in its positions of retraction and extension. As seen in FIGS. 4 and 5, mechanism 19 includes a screw 21 provided with a rectangular shaped abutment 23. Screw 21 may include a washer 22 and is threadedly received within a correspondingly threaded aperture 25 formed in sleeve 3 so that abutment 23 extends inwardly within sleeve 3 and into groove 11.

A resilient biasing means 27, preferably a coil spring made of metal or other suitable resilient material, is disposed within sleeve 3 for the purpose of biasing rod 9 outwardly towards an extended position. A handgrip 29 is provided on the opposite end of rod 9 to facilitate manual grasping and manipulation of handle 1. Handgrip 29 may be made of rubber or similar elastomeric material affording suitable friction and padding comfort for the hand of the tool user.

Through a single I-shaped groove 11 is disclosed, it is to be understood that a contiguous series of such grooves may be disposed along the longitudinal surface of rod 9 to thereby provide a plurality of transverse leg portions identical to leg portions 15 and 17. The only requirement being that any such groove arrangement be one of a continuous nature and within which abutment 23 may make engagement throughout substantially all portions thereof.

MODE OF OPERATION

The manner of operation of handle 1 will now be described in accordance with the utilization of a ratchet wrench as depicted for tool headpiece 5. In its fully retracted position, rod 9 is fully telescoped within sleeve 3 against the compression of spring 27 and secured against removal from this position by abutment 23 of latch mechanism 19 being disposed in either extremity of second leg portion 17. In this position, handle 1 may be utilized in removing or attaching threaded bolts through headpiece 5 when only the usual or moderate degrees of torque are required. In the event that a greater degree of torque becomes necessary in the tightening or loosening of a bolt, rod 9 is grasped by the user through grip 29 and rotated in either a clockwise or counterclockwise direction, depending on which end of leg portion 17 abutment 23 is disposed, in order to align abutment 23 with longitudinal leg portion 13 of groove 11. With rod 9 in this position, spring 27 is then free to expand and extend rod 9 outwardly of sleeve 3 towards an extended position. During this extension, abutment 23 continuously engages leg portion 13 of groove 11 until first leg portion 15 is reached, at which point rod 9 has been fully extended to a maximum degree. Rod 9 may then be rotated either clockwise or counterclockwise so that abutment 23 engages either extremity of leg portion 15 to thereby securely lock rod 9 against any reciprocating movement with respect to sleeve 3. In this fully extended position, the overall effective length of handle 1 has been increased to an extent substantially equal to the distance between leg portions 15 and 17, thereby according increased leverage and greater torque when force is applied to a bolt through grip 29. When it is no longer necessary to utilize handle 11 in its extended position, retraction and securing of rod 9 within sleeve 3 is accomplished by a procedure exactly reverse to that utilized for extension, with the primary difference being that rod 9 will be telescoped back into sleeve 3 against the biasing force of spring 27.

It is to be understood that the forms of the invention herewith shown and described are to be taken as preferred examples of the same, and that various changes in the shape, size and arrangement of parts may be resorted to without departing from the spirit of the invention or scope of the subjoined claims.

I claim:

1. An extensible tool handle for applying different degrees of torque to a tool headpiece, which handle comprises, in combination:
   a. a sleeve for supporting the tool headpiece at one end of the sleeve,
   b. a rod telescopically received within the other end of the sleeve and having at least one I-shaped groove along the surface thereof for permitting the rod to assume at least one position of retraction and at least one position of extension with respect to the sleeve,
   c. resilient means disposed within the sleeve for biasing the rod towards the position of extension,
   d. latch means carried by the sleeve for engaging the groove and locking the rod against movement with respect to the sleeve in the positions of retraction and extension, and
   e. a handgrip carried by the free end of the rod, which handgrip remains substantially entirely outside of the sleeve when the rod is in the position of retraction.

2. The handle of claim 1 wherein the tool headpiece is a wrench.

3. The handle of claim 1 wherein the resilient means includes a coil spring.

4. The handle of claim 1 wherein the latch means includes a screw having an inwardly projecting abutment for engaging the groove.

5. The handle of claim 1 wherein the groove includes:
   a. at least one longitudinal leg portion engaging the latch means during retraction and extension of the rod,
   b. at least one transverse leg portion engaging the latch means for locking the rod in a position of retraction upon rotation of the rod, and
   c. at least one transverse leg portion engaging the latch means for locking the rod in a position of extension upon rotation of the rod.

* * * * *